US007470168B1

(12) United States Patent
Farrell

(10) Patent No.: US 7,470,168 B1
(45) Date of Patent: Dec. 30, 2008

(54) SUPPORT BRA WITH REINFORCED CUPS

(76) Inventor: Charles J. Farrell, 8 Wayside Dr., Santa Rosa, CA (US) 95407

( * ) Notice: Subject to any disclaimer, the term of this patent is extended or adjusted under 35 U.S.C. 154(b) by 9 days.

(21) Appl. No.: 11/895,317

(22) Filed: Aug. 23, 2007

Related U.S. Application Data

(63) Continuation-in-part of application No. 10/662,590, filed on Sep. 15, 2003, now abandoned.

(51) Int. Cl.
*A41C 3/00* (2006.01)

(52) U.S. Cl. ..... 450/47; 459/51

(58) Field of Classification Search ..... 450/3, 450/36, 37, 39, 41, 43, 44, 47, 49, 51, 59, 450/60, 64, 78, 86, 87, 90; 2/104, 73, 78.1–78.4
See application file for complete search history.

(56) References Cited

U.S. PATENT DOCUMENTS 1,019,537 A * 3/1912 Schwenkler ..... 450/64
1,664,926 A * 4/1928 Imershein et al. ..... 450/51
2,015,151 A * 9/1935 Moity ..... 450/68
2,406,576 A * 8/1946 Ax ..... 450/51
2,452,345 A * 10/1948 Anselmo ..... 450/1
2,523,715 A * 9/1950 Panes ..... 450/60
2,530,829 A * 11/1950 Licht ..... 450/52
2,986,143 A * 5/1961 Erteszek ..... 450/60
3,200,821 A * 8/1965 Anderson ..... 450/68
3,710,800 A * 1/1973 Carey ..... 450/64
5,971,834 A * 10/1999 Murray ..... 450/68
6,180,178 B1 * 1/2001 Vogt ..... 427/389.9

* cited by examiner

*Primary Examiner*—Gloria Hale
(74) *Attorney, Agent, or Firm*—Craig M. Stainbrook; Stainbrook & Stainbrook, LLP

(57) ABSTRACT

A reinforced support bra having a pair of generally conically-shaped cups arranged for supporting a pair of breasts, each of the cups including an outer edge and a nipple tip portion. A back strap is attached to the cups and positioned for wearing around the torso, in the conventional fashion. Shoulder straps connected the top of the cups and the back strap and are adapted for placement over a wearer's shoulders. A non-stretchable reinforcing ring is attached to each of the cups and is placed generally concentric with the nipple tip portion between 40 percent and 95 percent of the distance from the outer edge of the cup and the nipple tip portion of said cup. Shoulder strap extensions may be provided and connected from the top of the cup to the ring to a shoulder strap, and slidingly disposed through a slide buckle so that lift can be tailored to the wearer's needs and preferences.

8 Claims, 4 Drawing Sheets

SUPPORT BRA WITH REINFORCED CUPS

CROSS REFERENCES TO RELATED APPLICATIONS

The present application is a continuation-in-part of U.S. Utility patent application Ser. No. 10/662,590, filed Sep. 15, 2003, now abandoned.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The invention broadly relates to bras, and more particularly to specialty support bras, and still more particularly to a support bra that provides extensive support for large breasted women.

2. Discussion of Related Art Including Information Disclosed Under 37 CFR §§1.97, 1.98

Many women dislike the appearance and size of their breasts. Because breasts are perceived as an important element in a woman's sex appeal, and because the popular culture and media have focused disproportionately on breasts, women are constantly confronted with images showing what is regarded as an ideal. Not unexpectedly, women desire to have a figure that matches that ideal, whether they perceive their breasts as too small or too large.

Accordingly, if ever there were something that could be called a blessing and a curse, it is large breasts. To the extent that large breasts are often highly desired by men (perhaps by those with a measure of breast fetishism), a woman with large breasts may experience her large breasts as a blessing (at least to the degree that she can enjoy a particular kind of attention from men); but to the extent that large breasts cause self-consciousness, discomfort, adversely affect posture and cause back ache, and invite unwanted, narrowly focused salacious attention, a women may consider her large breasts a curse.

Breast reduction surgery has thus been proposed and provided for particularly problematic cases. But many women shy away from such a drastic solution, as it carries medical risks and can be painful and disfiguring.

Support bras provide a measure of relief, but for large and heavy breasts, even support bras may not suffice. In addition, the bra straps may cut deep into the wearer's shoulders, posture can be adversely affected. Most support bras borrow the conventional bra design, perhaps with some increased fabric thickness and strength, along with increased strap size and strength. A conventional bra shown in FIG. 1 includes a horizontal adjustable back strap 10 attached to the bottom edges of a pair of cups 11 and 12, and a pair of vertical adjustable shoulder straps 13 and 14 attached to the tops of cups 11 and 12. Cups 11 and 12 are typically made of a relatively thin material and are prone to sagging under the weight of large breasts. Even when made from relatively stiff and sturdy material, such a design is ill-suited for providing optimal support for large breasts. Although shoulder straps 13 and 14 can be tightened to pull cups 11 and 12 upward, the breasts are flattened out of shape in the process.

Many innovative ideas have been tried in an effort to provide increased breast support in a brassiere. A few exemplary patents are discussed below.

U.S. Pat. No. 2,452,345 to Anselmo, shows an interesting bra design that includes openings at the nipple portion. The stated purpose of this design is to increase comfort by removing pressure from the wearer's nipples. It is indicated that the bra is also intended to provide uplift, but other than the nipple openings, there is nothing notable in the design that would suggest superior uplift capabilities.

U.S. Pat. No. 5,024,628, to Sanchez, teaches a maternity and nursing bra incorporating a one-handed fastening method that inherently allows for a stronger cup support and variable adjustment of cup size. It is accomplished by affixing parts of a fastener to the inside of an inner cup to an inner band. The bra includes a variable strap width adjusting band and relocatable shoulder straps. This enables the bra to be worn with a variety of outer garment styles.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The brassiere of the present invention is specifically adapted to provide uplift and support for large breasts. It includes a horizontal back strap, a pair of cups, a non-stretchable ring disposed generally around (and concentric with) the areola area of the front of each cup, and right and left vertical shoulder straps connecting to the top of the respective right and left cups, each extending to a non-stretchable ring. The rings may extend from a medial portion of the cup to the tip of the cup (i.e., the tip of the nipple area), in which event the entire outer portion of the cup would be fabricated from the same material from the point where the shoulder straps extend and connect to the rings to the tip of the nipple on the cup. More preferably, however, the rings include open centers—meaning that each ring comprises a discrete annular member or band that is fabricated from material different from the outermost (most distal) portion of the cup, as the outermost material is preferably soft, whereas the ring is preferably generally rigid and inflexible. Stated somewhat differently, the rings are not themselves conical cups, or subportions of the brassier cup; rather, they each comprise a band encircling a portion of a conical cup. Each non-stretchable ring is preferably located in a region approximately between 40-95 percent of the distance from the edge of the cup to the tip (outermost or most distal portion) of the nipple area, and optimally between 70-80 percent of that distance.

In a second preferred embodiment, the inventive apparatus includes shoulder straps which are moveable upward and downward through slide buckles attached to the tops of the cups for adjusting the lift provided by the bra.

It is therefore an object of the present invention to provide a new and improved support bra for large breasted women.

It is another object of the present invention to provide a new and improved support bra having cups reinforced by non-stretchable support rings.

A further object or feature of the present invention is a new and improved support bra that is inexpensive to manufacture and therefore inexpensive for the consumer.

An even further object of the present invention is to provide a novel support bra that allows a woman to tailor the amount of uplift provided at the distal portion of her breasts.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
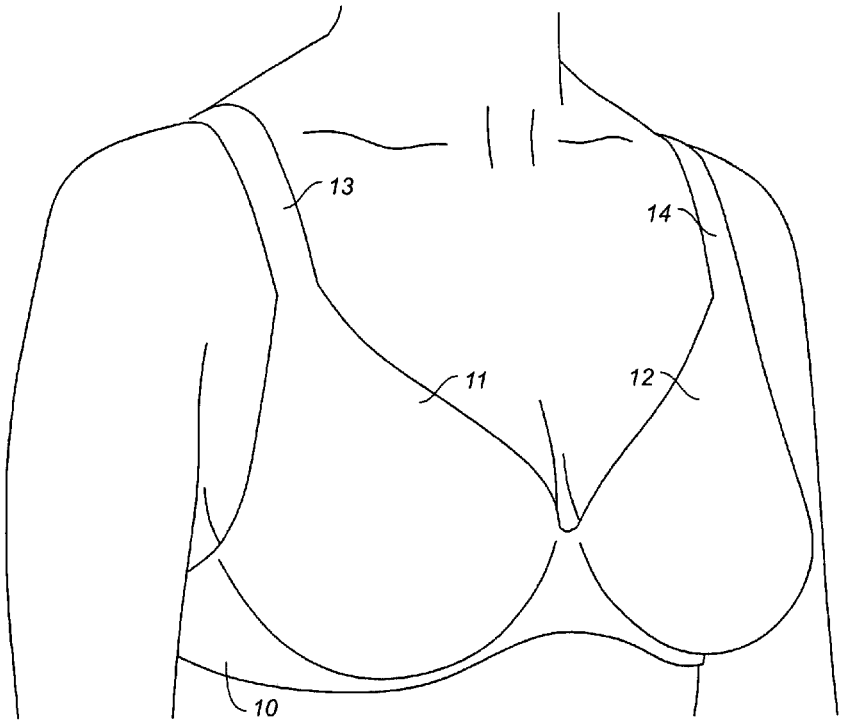
FIG. 1(PRIOR ART)
FIG. 1 is a front perspective view of a prior art bra.

Referring to FIGS. 1 through 4, wherein like reference numerals refer to like components in the various views, there is illustrated therein a new and improved support bra with cups reinforced by non-stretchable rings disposed on the bra cup on a portion distal to the cup edge and away from the chest wall.

Figure 2:
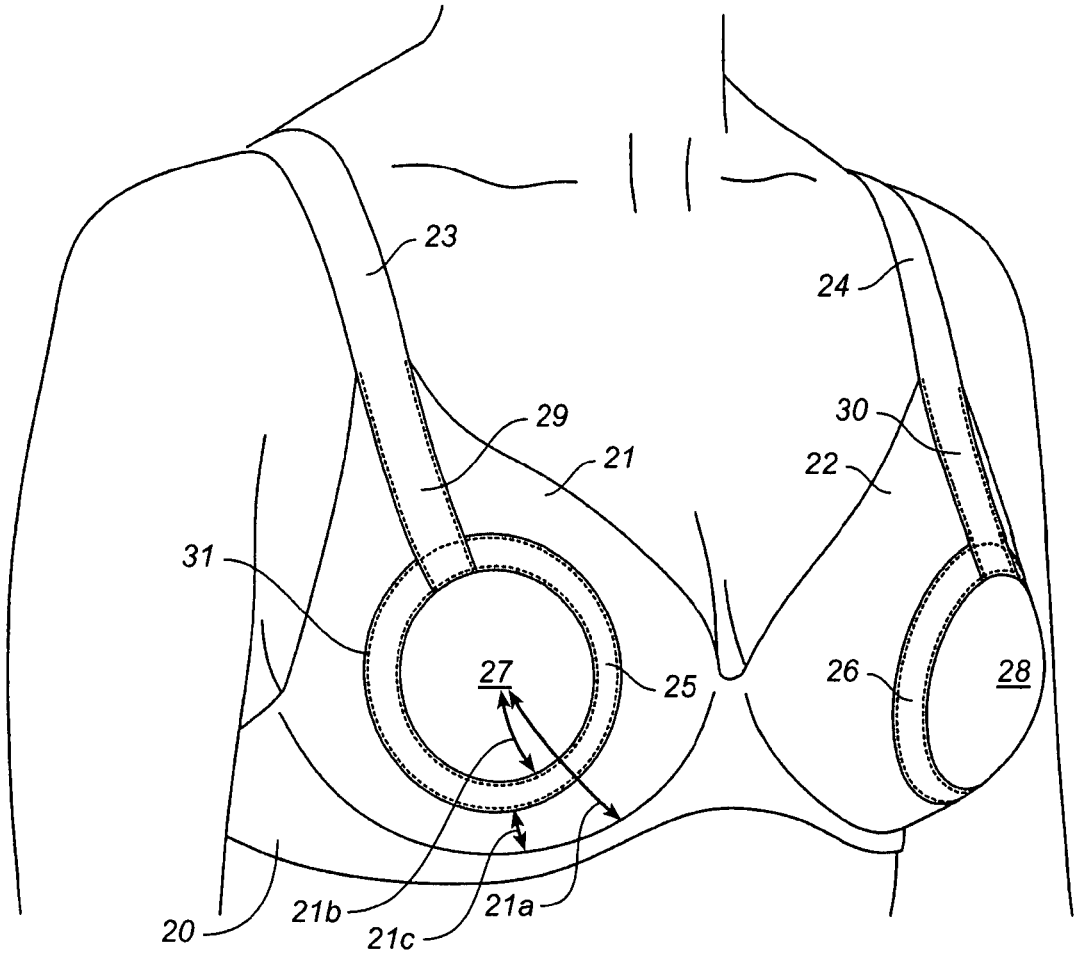
FIG. 2 is a front perspective view of the present bra with reinforced cups.

FIG. 2 illustrates a first preferred embodiment of the inventive support bra, and shows that the apparatus comprises a horizontal back strap 20 for positioning around a woman's upper torso. Back strap 20 may have a front closure or a back closure and may be adjustable in length. Back strap 20 extends integrally from, or is attached to, the bottom edges of a pair of generally conically shaped cups 21 and 22 arranged for supporting a pair of breasts. Right and left shoulder straps 23 and 24 connect the top of right and left cups 21 and 22 to back strap 20 for strapping over the right and left shoulders of the wearer.

Non-stretchable reinforcing rings 25 and 26 are attached to, and disposed along, the fronts of cups 21 and 22 generally concentrically with the nipple tips 27 and 28. Rings 25 and 26 are made of a generally inflexible, non-stretchable material than the cups. Shoulder straps 23, 24, integrally extend from a first attachment point at the top edge of the cup to include a non-stretchable suspension portion 29 and 30 connected to its respective ring, 25 and 26. Rings 25 and 26 and shoulder strap extension straps 29 and 30 are fixedly attached to cups 21 and 22, for example, by stitching 31. Alternatively, other means of attachment may be employed. Shoulder strap extension straps 29 and 30 are preferably integral extensions of shoulder straps 23 and 24, although they may be independent straps from vertical straps 23 and 24 but fixedly connected to them.

For optimal lift, the reinforcing rings are disposed distally from the cup edges preferably in the range of 40-95 percent of the distance from the cup edge to the nipple tip, and optimally in the range of 70-80 percent. Taking the right cup 21 as an example, the distance from the cup outer edge to the nipple tip 27 is denominated by 21*a*, while the distance from the nipple tip 27 to the ring is denominated by 21*b*, and the distance from the cup edge to the ring is denominated by 21*c*. The desired distance 21*b* of the ring placement should not be less than 5 percent of the total distance 21*a* from the cup edge to the nipple tip, while distance 21*c* should not be less than 40 percent of the distance 21*a* from the cup edge to the nipple tip. Optimally, the ring is disposed at a point between 70 and 80 percent of the distance 21*a* from the cup edge to the nipple tip.

Shoulder strap extension straps 29 and 30 are sized to suspend rings 25 and 26 at the above-described optimal positions relative to the top ends of cups 21 and 22 and to prevent the forward portions of cups 21 and 22 from sagging under the weight of large breasts. Rings 25 and 26 maintain the shapes of cups 21 and 22 to prevent them from flattening the breasts when shoulder straps 23 and 24 are tightened.

Figure 3:
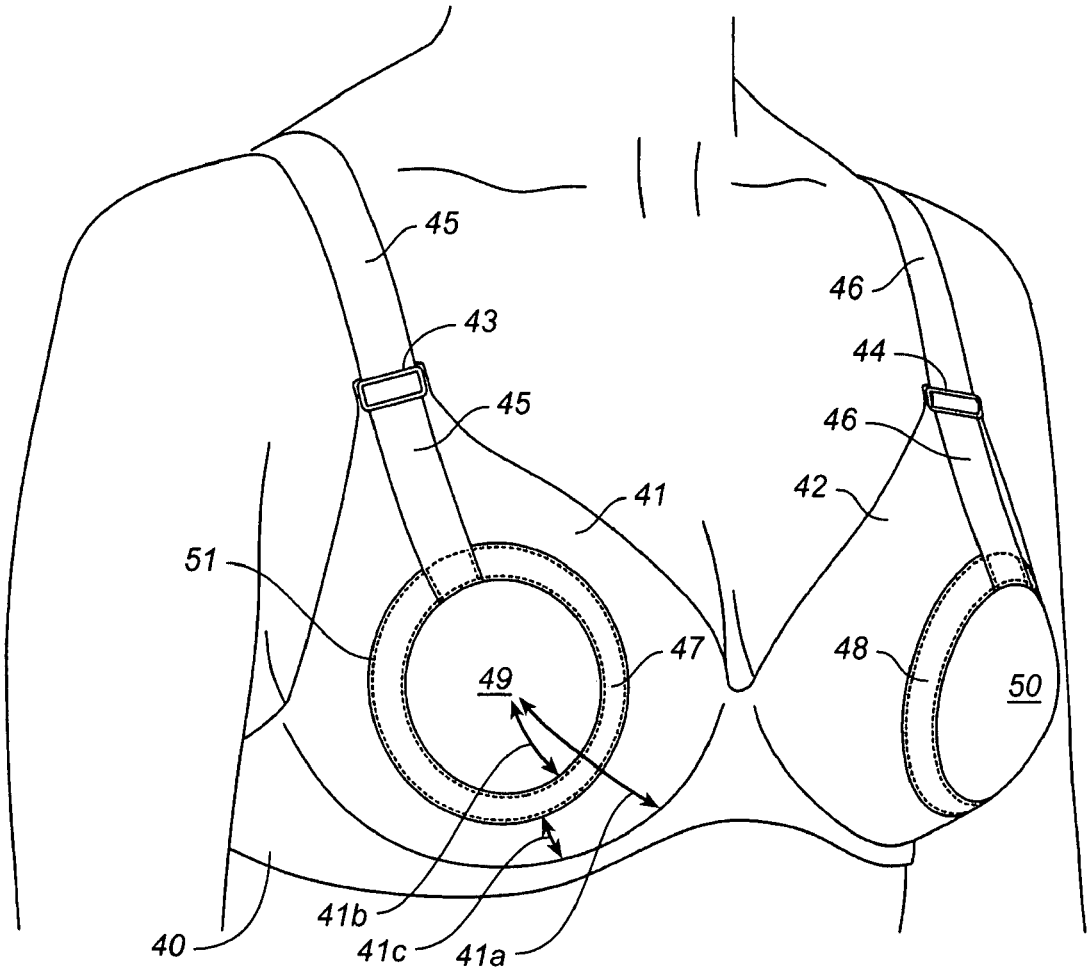
FIG. 3 is a front perspective view of a second embodiment of the present bra.
Figure 4:
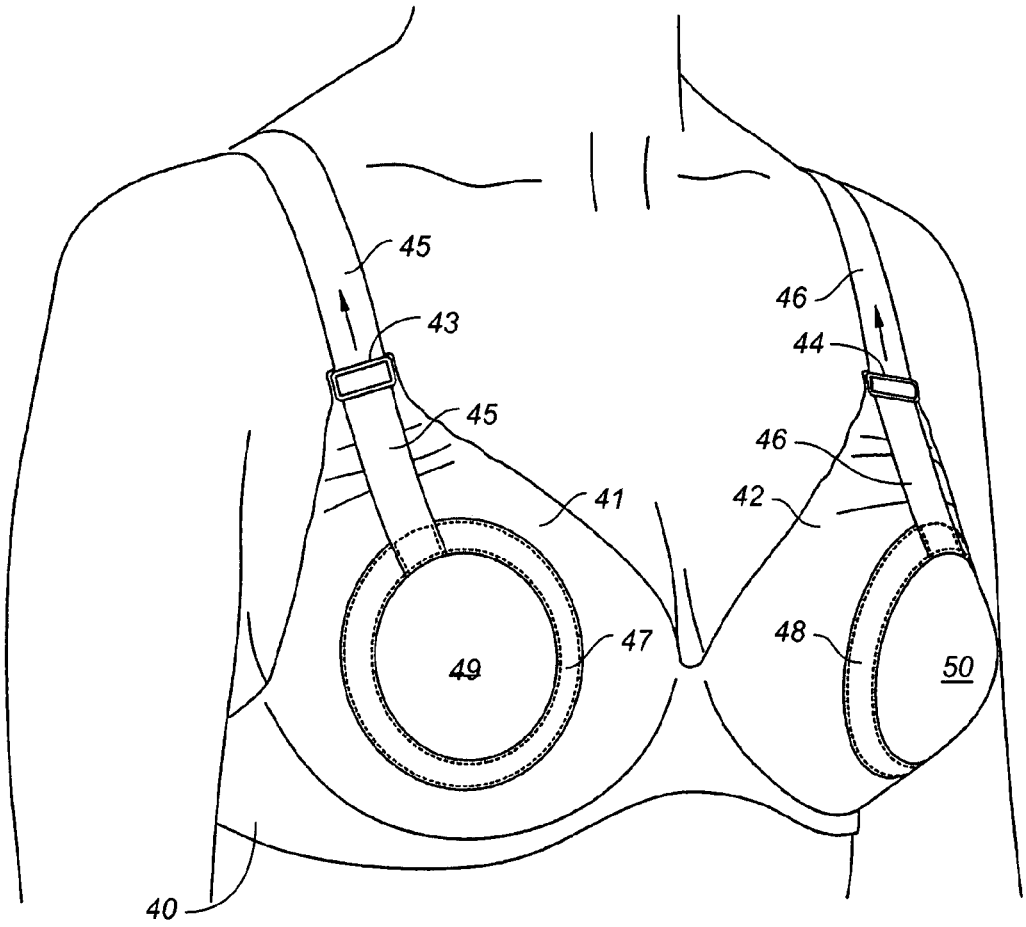
FIG. 4 is a front perspective view of the bra of FIG. 3 with shoulder straps tightened.

In an alternative embodiment, shown in FIGS. 3-4, the support bra of the present invention includes a back strap 40 that may have a front closure or a back closure, and may be adjustable in length. Back strap 40 is attached to the bottom edges of cups 41 and 42 arranged for supporting a pair of breasts. Slide buckles 43 and 44 are affixed to the tops of cups 41 and 42. Shoulder straps 45 and 46 are connected between slide buckles 43 and 44 and back strap 40 for strapping over a wearer's shoulders, and each shoulder strap extends through a slide buckle to attach to a non-stretchable reinforcing ring 47 and 48, which are disposed on and attached to the front of cups 41 and 42 in precisely the manner and location as described above for the first preferred embodiment of the present invention. The rings are again generally concentric with nipple areas 49 and 50, and are affixed to the cups, preferably by stitching 51. Alternatively, other means of attachment may be employed.

The lower ends of shoulder straps 45 and 46 are connected to rings 47 and 48, receptively, but are not fixedly connected to any other portion of cups 41 and 42. The tops of cups 41 and 42 are moveable along shoulder straps 45 by moving strap through the slide buckles 43 and 44 to adjust the distance between rings 47 and 48 and the tops of cups 41 and 42, and thus control the lift provided by cups 41 and 42.

Referring now to FIG. 4, it will be seen that shoulder straps 45 and 46 are shortened between rings 47 and 48 and the tops of cups 41 and 42 for lifting the forward portions of cups 41 and 42 to prevent the cups from sagging under the weight of large breasts. Shoulder straps 45 and 46 can also be lengthened between rings 47 and 48 and the tops of cups 41 and 42 for reducing lifting when desired.

As in the first preferred embodiment, the non-stretchable reinforcing rings are disposed distally from the cup edges preferably in the range of 40-95 percent of the distance from the cup edge to the nipple tip, and optimally in the range of 70-80 percent. Again using the right cup 41 for purposes of illustration, the distance from the cup outer edge to the nipple tip 49 is denominated by 41*a*, while the distance from the nipple tip to the ring is denominated by 41*b*, and the distance from the cup edge to the ring is denominated by 41*c*. The desired distance 41*b* of the ring placement should not be less than 5 percent of the total distance 41*a* from the cup edge to the nipple tip, while distance 41*c* should not be less than 40 percent of the distance 41*a* from the cup edge to the nipple tip. Optimally, the placement of the ring is between 70 and 80 percent of distance 41*a* from the cup edge to the nipple tip.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A reinforced support bra, comprising:

a pair of generally conically-shaped cups arranged for supporting a pair of breasts, each of said cups having an outer edge, a top, and a nipple tip portion fabricated from soft material;

a back strap attached to said cups for positioning around a wearer's torso;

a pair of shoulder straps connected between said cups and said back strap for placement over a wearer's shoulders; and first and second non-stretchable reinforcing rings, one each attached to one of said cups and disposed distally from said outer edge of said cup and generally concentric with said nipple tip portion between 40 percent and 95 percent of the distance from said outer edge and said nipple tip portion of said cup;

wherein said each of shoulder straps are connected to a respective reinforcing ring, and further including a pair of slide buckles, one each attached to a respective top of one of said cups, wherein said shoulder straps are moveable within said slide buckles to adjust the distance between said rings and respective tops of said cups to control the lift provided by said bra.

2. The reinforced bra of claim 1, wherein said rings are fabricated from material more rigid than the material from which said cups are fabricated.

3. The reinforced bra of claim 1, further including a pair of generally non-stretchable shoulder strap extension straps, one each of said shoulder strap extension straps connected between a respective ring and a respective shoulder strap.

4. The reinforced bra of claim 3, wherein said shoulder strap extension straps are integral extensions of respective shoulder straps.

5. The reinforced bra of claim 3, wherein said each of said shoulder strap extension straps are sewn onto said cup between said ring and said shoulder strap.

6. The reinforced bra of claim 3, wherein said rings and said suspension strips are fabricated of material more rigid than the material from which said cups are fabricated.

7. The reinforced bra of claim 3, wherein said rings are disposed between 70 percent and 80 percent of the distance from said outer edge and said nipple tip portion of said cup.

8. The reinforced bra of claim 1, wherein said rings are disposed between 70 percent and 80 percent of the distance from said outer edge and said nipple tip portion of said cup.

* * * * *